US006669540B2

(12) United States Patent
Gripp et al.

(10) Patent No.: US 6,669,540 B2
(45) Date of Patent: Dec. 30, 2003

(54) CHUCK MEANS FOR FLAT WORKPIECES, IN PARTICULAR SEMI-CONDUCTOR WAFERS

(75) Inventors: Howe Gripp, Kellinghusen (DE); Paul Muller, Ostermiething (AT)

(73) Assignee: Peter Wolterss CMP-Systeme GmbH & Co. KG, Rendsburg (DE)

( * ) Notice: Subject to any disclaimer, the term of this patent is extended or adjusted under 35 U.S.C. 154(b) by 15 days.

(21) Appl. No.: 10/109,620

(22) Filed: Mar. 28, 2002

(65) Prior Publication Data

US 2003/0186632 A1 Oct. 2, 2003

(51) Int. Cl.[7] ..... B24B 29/00; B24B 47/00
(52) U.S. Cl. ..... 451/288; 451/388; 451/397
(58) Field of Search ..... 451/285, 286, 451/287, 288, 289, 388, 398

(56) References Cited

U.S. PATENT DOCUMENTS 6,093,091 A * 7/2000 Keller ..... 451/388
6,390,905 B1 * 5/2002 Korovin et al. ..... 451/286
6,422,928 B1 * 7/2002 Nakamura et al. ..... 451/288

FOREIGN PATENT DOCUMENTS

DE 197 55 975 6/1999

* cited by examiner

*Primary Examiner*—Dung Van Nguyen
(74) *Attorney, Agent, or Firm*—Vidas, Arrett & Steinkraus, P.A.

(57) ABSTRACT

A chuck means for flat workpieces, in particular semi-conductor wafer for the chemical-mechanical polishing, comprising a circular housing which is attached to a driving spindle for rotation therewith and has a top wall and an annular side wall, a retaining ring which forms the lower part of the side wall, a chuck plate of rigid, however elastically deformable material which has an upper and a lower side and a plurality of openings at the lower side as well which openings are in connection with radial and axial parallel passages in the chuck plate, the passages being in fluid connection with an axial passage in the spindle, the axial passage being connected to a vacuum and/or fluid source, the chuck plate being floatingly and vertically movably located in the housing, a plurality of pressure chambers above the chuck plate, the pressure chambers having lower wall portions which are yieldable and engage the upper side of the chuck plate, pressure manifold means which are connected with a fluid source under pressure and control the pressure in the individual pressure chambers, the lower chamber walls being in frictional engagement with the chuck plate for the transfer of torque from the spindle to the chuck plate, whereby the polishing pressure of the chuck plate essentially is generated by the pressure in the pressure chambers.

12 Claims, 5 Drawing Sheets

CHUCK MEANS FOR FLAT WORKPIECES, IN PARTICULAR SEMI-CONDUCTOR WAFERS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

A known method for the planarization of semi-conductor wafers in the semi-conductor industry is the so-called CMP process. This is a chemical-mechnical machining by means of a fluid (slurry), with the chemically reactive portion of the slurry having the objective to convert the material into a polishable condition. The slurry includes abrasive means in the form of colloidal abrasive small particles. The planarization of a semiconductor disk by CMP is an important step for the manufacture of plane defect-free and smooth semiconductor disks. Frequently, the CMP process is the last processing step in the manufacturing line and considerably influences the shape and the surface qualities of the semiconductor disk which as known is the blank material for the manufacture of electrical, electronic and microelectronic components (prime wafer manufacture). Also after the coating of semi-conductor wafers, for example with an oxide, tungsten or other metal layer, a CMP machining takes place in order to provide the desired quality of the surface. In case this is not achieved, problems occur with lithographic processes in the form of focus failures by steps of focal field of the UV stepper or in form of disturbances of the conductor paths.

During the transport and the machining of the wafers the wafers are held by a carrier. The objective of such carrier is to transfer a homogenous pressure field or different pressure profiles to the back side of the wafers. Conventionally, the carrier is retained and moved by an apparatus whereby the carrier is rotated about a vertical axis and linearly moved in vertical and horizontal direction.

From DE 197 55 975 A1 a carrier has become known which is attached to a spindle or shaft which can be vertically moved. The carrier has a chuck plate at the lower side which through a universal joint is coupled with a support portion above the chuck plate. The chuck plate includes a plurality of bores which extend to the lower side of the chuck plate and which are connectable with a vacuum and/or a fluid source. The chuck plate is vertically movably guided by the support portion and an annular closed diaphragm is arranged between the support portion and the chuck plate, the diaphragm defining a sealed closed inner space which selectively can be connected to atmosphere, vacuum or a pressure source, respectively.

The objective of the invention is to provide chuck means for flat workpieces, in particular for wafers which enable a particular effective processing of the surfaces of the workpieces.

BACKGROUND OF THE INVENTION

Similar to conventional chucks or carriers for semiconductor wafers for the CMP polishing the invention provides a circular housing which is connected to a driving spindle or a shaft for rotation therewith. The housing includes a top wall and an annular side wall. The chuck plate is made of relatively rigid, however, elastically deformable material, for example of steel or plastic material and has ports at the lower side for the holding of wafers by vacuum. The chuck plate is floatingly arranged in the housing. It can freely move upwards and downwards and is laterally limited by a retainer ring which forms the side wall of the housing in the area of the chuck plate. A plurality of pressure chambers is provided above the chuck plate which have a desired shape and distribution. The pressure chambers can be concentrically arranged about the spindle axis and divided by radial walls. The pressure chambers are connected to a pressure manifold means which in turn is connected to a fluid source under pressure. By means of the pressure manifold means the pressure in the individual pressure chambers can be controlled. The pressure chambers have lower wall portions which are resilient, in particular flexible. The lower wall portions engage the upper side of the chuck plate and determine the pressure of the chuck plate onto the workpiece beyond the gravity force of the chuck plate if the workpiece lies on a polishing table. Thus, the polishing pressure of the chuck plate is solely determined by the pressure in the individual pressure chambers.

The transfer of the torque from the spindle to the chuck plate solely takes place though the frictional engagement of the lower chamber walls with the chuck plate.

The pressure force which is transferred from the pressure chamber to the chuck plate has the same value at any location in the pressure chamber. By the selection of the pressure in the pressure chambers the polishing result can be influenced.

The retainer ring at the housing can be splitted so that it can be easily released from the housing which allows the removal of the chuck plate. Frequently, a polishing cloth is adhered to the chuck plate. The cloth is a wear part and thus must be replaced from time to time. By the easy removal of the chuck plate, the replacement can be easily carried out at a remote location.

It is conceivable to have separate pressure conduits connected with the individual valves which are connected to the pressure chambers. The supply apparently has to take place through the spindle. Therefore, it is more simple and not particularly disadvantageous if only switching valves are associated with the pressure chambers which are connected to a common pressure control valve in order to generate selectively the pressure in desired pressure chambers. The pressure control valve can be located outside of the housing or the spindle, respectively, and connected to an axial passage within the spindle through a rotary duct. The passage in the spindle is connected to the individual switching valves in the housing. The switching valves are electrically controllable, with an external control device for the switching valves being connected to the switching valves through electrical conductors. The conductors could be connected to electrical lines within the spindle or the housing by sliding contact ring means associated with the spindle or the carrier. Also a contactless transmission can take place, e.g. through electromagnetic waves or infrared means.

It is conceivable to provide pressure control valves for the individual pressure chambers. However, small proportional valves which would be necessary, are not available.

The pressure chambers could be formed by a folded membrane which has upper and lower portions which alternate in radial direction. The upper portions can be connected to a plate within the housing, preferably through annular clamping rings so that the membrane rotates upon rotation of the spindle and the housing. The lower portions of the membrane have a larger thickness and engage the upper side of the chuck plate and transfer the torque onto the chuck plate through friction force. As the membrane is of an elastic material which has a small inherent rigidity, angle failures between the driving spindle and the polishing table and the polishing station can be compensated.

In the invention, the chuck plate can be formed as plane disk which can be deformed by means of the pressure chambers in the desired manner. The guidance of the chuck plate can be achieved by a cylindrical circumference of the plate which is guided by the housing or the mentioned retainer ring. To this purpose an annular groove can be formed at the circumference of the chuck plate, and a radially inwardly facing annular extension of the retaining ring can engage the groove in order to limit the vertical movement of the chuck plate.

The construction according to the invention can provide for a simple removal of the chuck plate as already described above. The passages of the chuck plate are connected to vacuum or a fluid source, respectively, through a passage in the spindle. Therefore, for this case the invention provides for a coupling which includes a part connected to the chuck plate and a part connected to the housing which in the coupled condition provides for a fluid connection to the passages in the chuck plate. The coupling must be structured such that the chuck plate can be easily released from the other coupling part in the housing after the retainer ring has been removed. As to this, a quick closure thread locking means is provided, e.g. formed by a helical groove in the coupling part secured to the housing, a projection of the coupling part connected to the chuck plate engaging the groove. By a respective rotation of the chuck plate, the coupling parts can be separated or coupled. By means of this construction the polishing cloth which is normally attached to the chuck plate can be easily removed from the chuck plate and replaced by another one.

The coupling part within the housing has to move with the vertical movement of the chuck plate, e.g. by its deformation but also by the vertical movement in operation. Therefore, this coupling part is vertically movable and preferably biased towards the chuck plate by means of a spring. A flexible conduit in the housing connects the coupling part in the housing with an axial passage in the spindle. Preferably, the coupling part within the housing consists of two portions, namely a first portion which forms a plug socket connection with a socket-like coupling part of the chuck plate and a second portion wherein the first portion is rotatably accommodated, however, secured against axial movement. The second portion is connected to a flexible conduit portion. The first portion is biased by a spring towards the chuck plate and is prevented from rotation in a lower position. If the first portion, however, is upwardly displaced after the coupling of the parts has taken place, the first portion can freely rotate. This is necessary because of the frictional transfer of the torque from the membrane to the chuck plate and a relative rotation between membrane and chuck plate may occur. Upon such relative rotation, the second portion of the second coupling part must not be rotated. The first portion, however, can freely rotate in the second portion so that no damages of the parts can occur.

BRIEF DESCRIPTION OF THE SEVERAL VIEWS OF THE DRAWINGS

In the following, an embodiment example of the invention is explained in more detail, wherein.

DETAILED DESCRIPTION OF THE INVENTION

While this invention may be embodied in many different forms the are described in detail herein a specific preferred embodiment of the invention. This description is an exemplification of the principles of the invention and is not intended to limit the invention to the particular embodiment illustrated.

Figure 1:
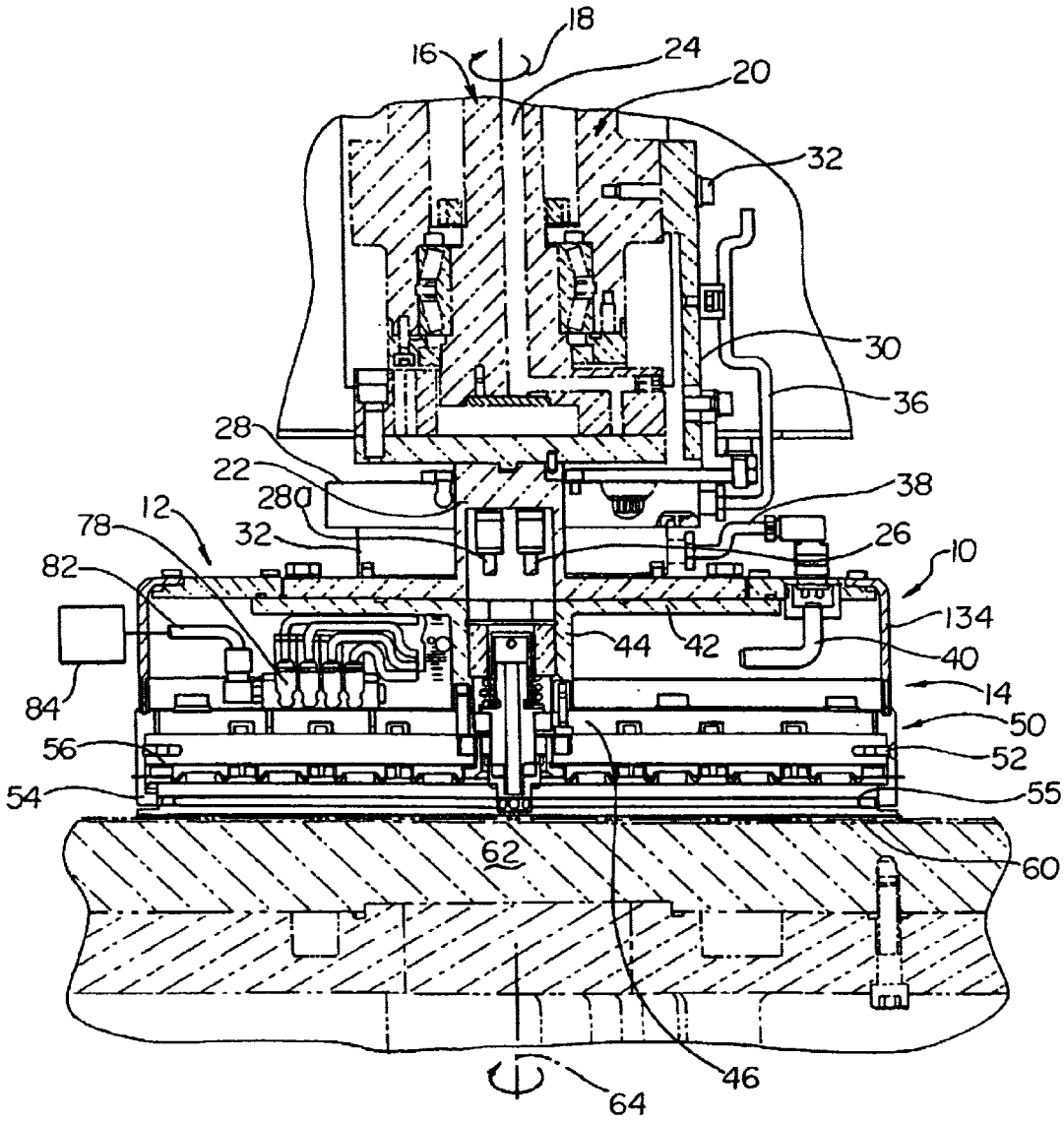
FIG. 1 shows a cross section through a chuck according to the invention during a polishing operation.

In FIG. 1 a cylindrical chuck 10 can be seen having a top wall 12 and an annular side wall 14. A vertical shaft or a spindle 16 is rotated according to arrow 18 and is borne by a sleeve-shaped bearing arrangement 20. The rotary bearing is not described in detail. The bearing arrangement 20 can be vertically moved by a suitable device (not shown), and the spindle 16 can be rotated by a suitable driving motor (not shown). Through a central hollow trunnion 22 the spindle 16 is connected to the top wall for rotation therewith. An axial passage 24 extends within the spindle, the passage being connected to a first conducting portion 26 (not shown in detail). A further axial passage in spindle 16 not shown in FIG. 1 is connected with a further conducting portion 28*a*. Upon rotation of spindle 16, the housing of the chuck is rotated.

An annular element 28 extends around trunnion 22 and is held by retaining means 30 which at 32 are threaded to the bearing arrangement 20. A second annular element 32 is mounted on the upper side of top wall 12 and rotates therewith. The elements 28, 32 represent a sliding ring or commutator arrangement for the transmission of electrical signals. A cable 36 which is connected to a control device not shown is connected to the annular element 28 which forms the stator of the sliding ring arrangement, and a cable connection 38 is connected to the annular element 32 which forms the rotor and is introduced into the interior of the housing as can be seen at 40. The function of cable 40 will be described later.

A flange 42 is attached to the lower side of top wall 12, the flange 42 having a downwardly extending cylindrical hollow extension 44. A plate 46 is screwed to the extension 44, and a further plate 48 is connected to plate 46 by means of threaded fasteners. A retainer ring 50 is attached to the circumference of the circular plate 48 by threaded fasteners 52. The retainer ring 50 at the lower portion has a radially inwardly extending annular extension 54. The retainer ring 50 is splitted and can be easily removed after removal of screws 52.

A folded diaphragm 56 is connected to the lower side of plate 48, the diaphragm lying on a chuck plate 58. A polishing cloth is attached to the lower side of the chuck plate. At 60, a wafer is indicated which is polished by a polishing table diagrammatically shown at 62. The polishing table for example is supported for rotation about an axis 64 and driven (not shown in detail).

Figure 2:
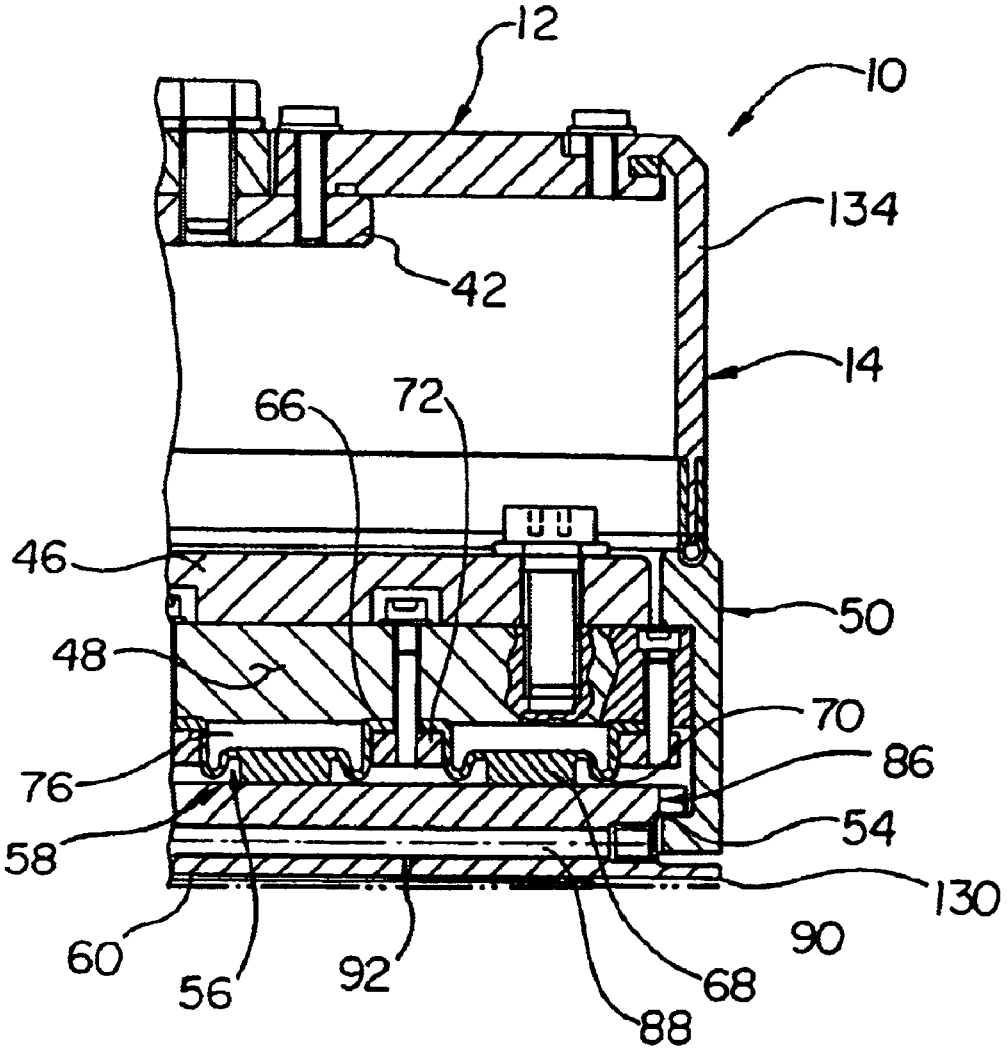
FIG. 2 shows in an enlarged scale a marginal portion of the chuck of FIG. 1.
Figure 3:
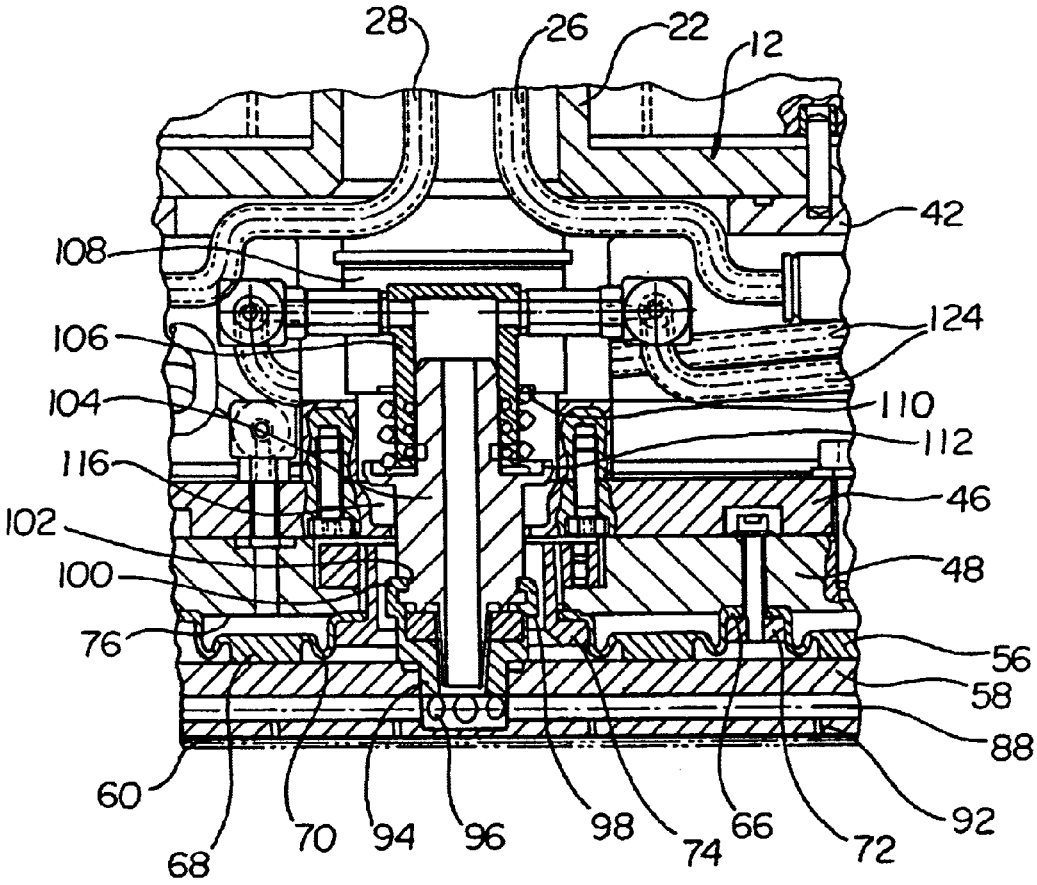
FIG. 3 shows enlarged a central portion of the chuck of FIG. 1.
Figure 4:
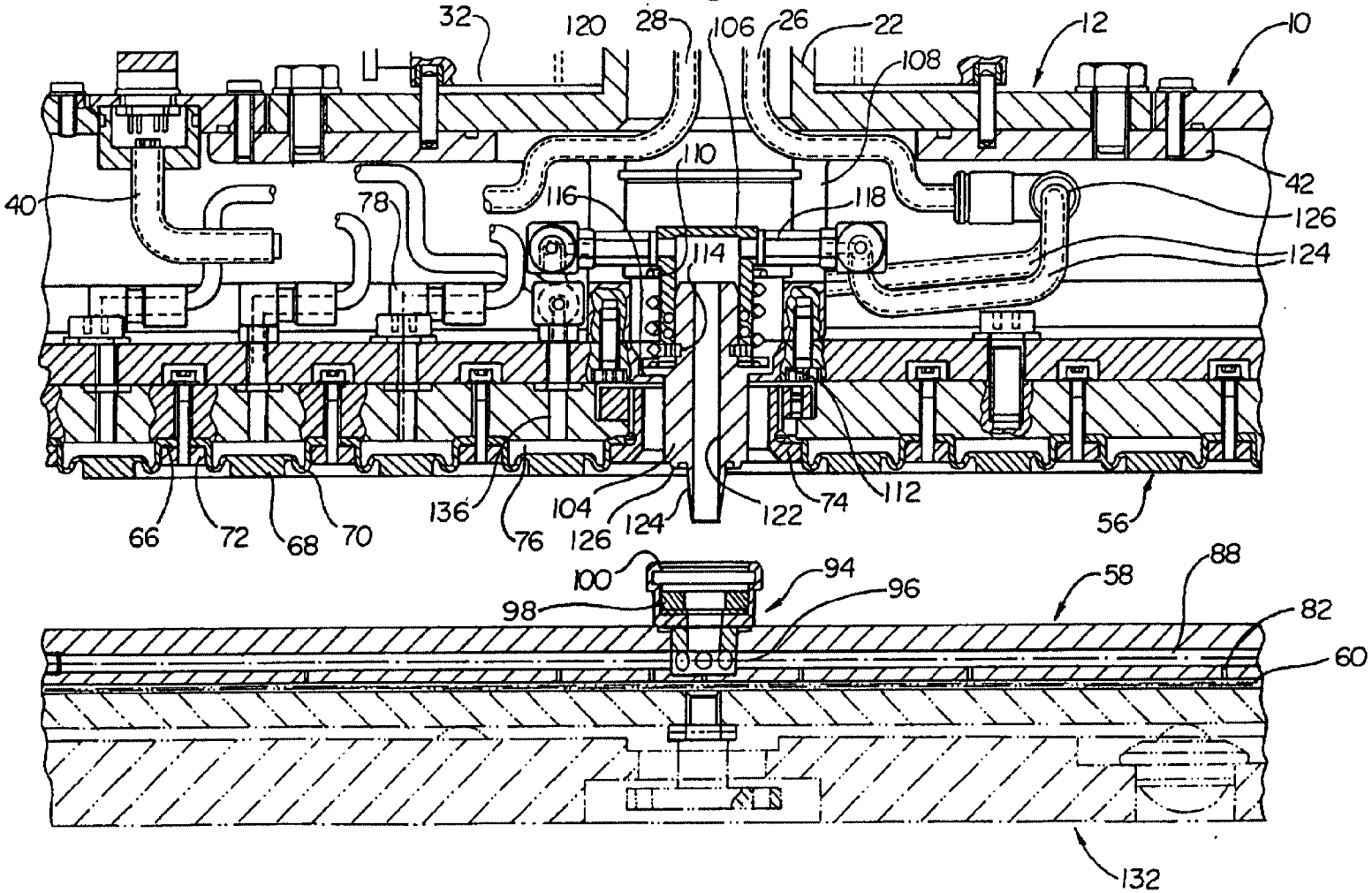
FIG. 4 shows enlarged a cross section through a central portion of the chuck of FIG. 1 with removed chuck plate.

The last mentioned parts can be seen more clearly in the FIGS. 2 to 4. The integral diaphragm 56 has upper annular portions 66 and lower annular portions 68 which alternate in radial direction. The annular portions 66, 68 are interconnected by folds 70. The upper portions 66 are pressed against the lower side of plate 48 by clamping rings 72 and screws. The lower annular portions 68 are relatively thick and engage the upper side of chuck plate 58. The complete diaphragm 56 is annular and made of relatively flexible material. The attachment and sealing of the diaphragm 56 at the radially inner side takes place by a flange sleeve 74 to plate 48 (see FIGS. 3 and 4). Four annular pressure chambers 76 are defined by plate 48 and the described portions of the diaphragm 56. The pressure chambers 76 are concentrically relative to each other and to the axis of spindle 16. Each pressure chamber 76 is connected to a switching valve 78 through conduits 80 (see also FIG. 1). In FIG. 1 it can be seen that the four switching valves 78 are formed as a block which is arranged in housing 10 and connected with a conduit 82. This conduit is connected with the conduit 28 not shown in detail, the latter being in communication with an axial passage in spindle 16. The second axial passage is connected to an external pressure control valve through a rotary duct. This is indicated in FIG. 1 by block 84. By means of the pressure control valve, in conduit 82 a predetermined pressure can be generated. By a respective control of the valves 78 the desired pressure chamber 76 can be selected wherein a predetermined pressure is to be generated. It is understood that all pressure chambers 76 can be provided with a predetermined pressure. The control of valves 78 takes place through cable 40 which is connected with the external cable 36 through the described sliding arrangement 28, 30, the external cable 36 being led to the electrical control device not shown.

The circular chuck plate 58 has an annular groove 86 at its circumference, the radial annular extension 54 of the retainer ring 50 engaging the annular groove. Thus, the chuck plate 58 can be vertically moved within limits.

Star-like arranged passages 88 are provided in chuck plate 58, the ends of the passages being closed as shown at 90. The passages 88 are connected with bores 92 extending parallel to the axis of the chuck plate. The passages in the chuck plate terminate in radial openings 96 in the central bore of the chuck plate 58. As already mentioned, a polishing cloth is attached to the lower side of chuck plate 58 which, however, is permeable for gas. Alternatively, the polishing cloth may be provided with bores aligned with the bores 92. In case a vacuum is generated in passages 88 a holding force can be exerted upon wafer 60. This is used for the transport of the wafer. In order to transfer the vacuum into passages 88 a fluid coupling is provided. The fluid coupling comprises a cup-shaped first portion 94 which is threaded into a central bore of the chuck plate 58. In the upper enlarged portion of the coupling part 94 a sealing ring 98 is located. The upper end of the coupling part 94 is formed by diametrically opposed claws 100 which cooperate with helical groove portions 102 of a coupling portion 104. This coupling portion 104 in conjunction with a further coupling portion 106 forms the second coupling part.

A retaining element 108 which is centrally arranged within housing 10 and is fixedly attached to extension 44 supports a coil spring 110 which with the lower end coacts with a radial flange 112 of portion 104 in order to bias the portion 104 downwardly as can be seen in FIGS. 3 and 4. The spring 110 surrounds a hollow portion 106 into which the upper cylindrical portion of portion 104 is inserted. At 114, a rotary connection between portions 104 and 106 is formed which prevents an axial relative displacement of the theses parts. In the lower position of portion 104, flange 112 is positioned within a recess 116 of plate 46 and thus secured against rotation. However, if flange 112 is above recess 116, it can freely rotate (see FIG. 3).

The portion 106 in the upper area has two conduit fittings 118, 120 on opposing sides which are connected to the interior of the hollow portion 106. The portion 104 has a central throughbore 122 which terminates in a conical portion 124 which as can be seen in FIG. 3 can be inserted into the interior of coupling part 94. By this, a connection to the radial passages 88 is established. The fittings 118, 120 are connected to conduit portions 124 which are connected to a fluid coupling 126 which in turn is in communication with conduit 26. The latter as described is in communication with the axial passage 24 of the spindle. In this way, a vacuum can be generated in bores 92 or a fluid can be supplied to the bores if desired.

At the lower end of portion 104 an annular rib 126 is provided which sealingly engages the sealing ring 98 of coupling part 94.

When a wafer 60 is retained by vacuum at the lower side of chuck plate 58, the carrier 10 can lower onto the polishing table 62. The lowering takes place such that the chuck plate 58 may freely float so that the annular extension 54 forms a space with respect to the walls of groove 86. Thus, the chuck plate 58 only engages portions 68 of diaphragm 56. By means of the valves 84 and 78 in selected pressure chambers 76 a predetermined pressure in a predetermined distribution is established whereby a pressure on the chuck plate 58 is exerted and a partial deformation of the chuck plate 58 can take place if the pressure in chambers 76 is not equal. Thus, the polishing pressure on wafer 60 is solely generated by the pressure in the pressure chambers 76. The gravity force of chuck plate 58 and the force of spring 110 are constant forces which add to the pressure generated by the pressure chambers.

In FIG. 2 an annular extension can be seen at 130 having an inner diameter which is slightly larger than the outer diameter of wafer 60. By this, the wafer is radially secured if the polishing process takes place.

If the chuck plate 58 is to be removed, the retainer ring 50 is released as already described. A plate-like arrangement 132 not described in detail is placed below chuck plate 58 which may support the chuck plate 58 with the polishing cloth. The chuck plate then is rotated approximately about 90° in one rotary direction whereby the claws 100 are turned out of grooves 102 (FIG. 3). Then, the chuck plate 58 can be freely lowered.

Upon the mounting of chuck plate 58 the chuck plate is moved upwardly against diaphragm 56, with the portion 124 being inserted into coupling part 94 and rib 126 engaging sealing ring 98. The arrangement 132 is slightly movable and thus facilitates the centering of coupling part 94 and portion 124 upon assembly of chuck plate 58. The claws 100 of coupling part 94 are aligned with the grooves 102. Thereafter, the chuck plate 58 is rotated in opposite direction whereby the parts 104 and 94 are pressed against each other and are clamped. The chuck plate 58 is then moved upwardly towards diaphragm 56 until engagement therewith. The coupling portions 104 and 106 are commonly moved upwardly as indicated in FIG. 3. By this, a fluid connection is established with conduit 26. The coupling part 104 can freely rotate within coupling portion 106 in housing 10. Thus, a relative rotation of coupling portion 104 and coupling portion 106 is possible. This may occur through the frictional torque transmission from diaphragm 56 to chuck plate 58. Thus, a safety clutch is formed by this construction.

The conduits 124 are flexible and allow the described vertical movement of coupling portion 106.

An annular wall portion 134 which for example is made of plastic forms a shroud and protects the interior of housing 10. The shroud 134 must not provide a support function.

As mentioned, the pressure distribution on the deformable chuck plate 58 takes place by the pressure in the pressure chambers 76. The chuck plate 58 is relatively thick and for example is made of steel. The achievable deformations are relatively small, however, completely sufficient to obtain the desired pressure distribution upon the polishing process.

The pressure in the pressure chambers 76 is controlled by the adjustment of the pressure control valve 84 and the control of the switching valves 78. The switching valves are connected through pressure chambers 76 through axial parallel bores, as for example shown at 136.

Figure 5:
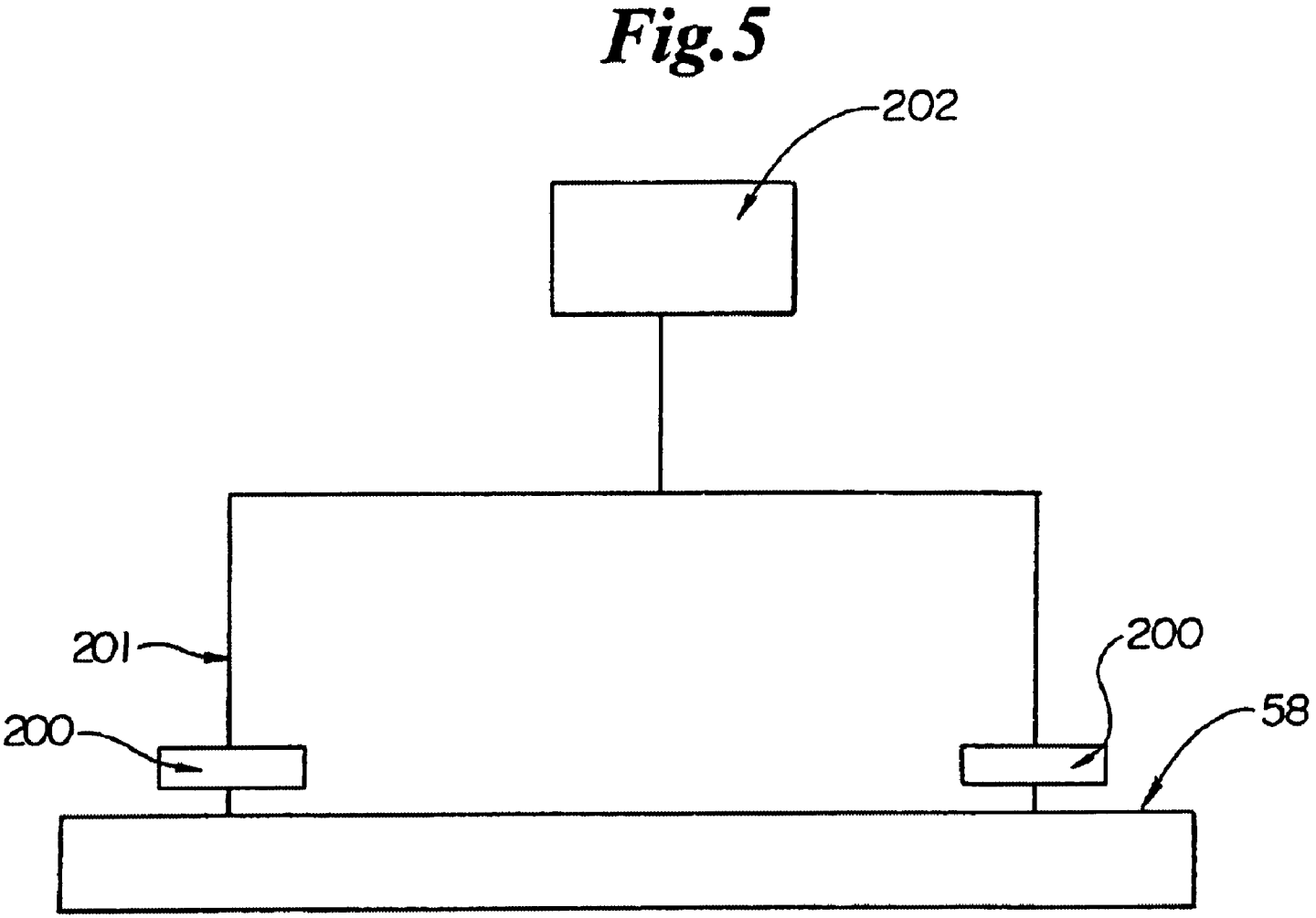
FIG. 5 is a block diagram showing the strain gauges connected to an external computer.

Referring now to FIG. 5, strain gauges 200 are attached to the upper side of the chuck plate, said strain gauges connected to an external computer 202 through transfer means 201 associated with the spindle.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A chuck means for semi-conductor wafers, in particular for the chemical-mechanical polishing of semi-conductor wafers, comprising a circular housing which is attached to a driving spindle for rotation therewith and has a top wall and an annular side wall, a retaining ring which forms the lower part of the side wall, a chuck plate of rigid, however elastically deformable material which has an upper and a lower side and a plurality of openings at the lower side as well which openings are in connection with radial and axial parallel passages in the chuck plate, the passages being in fluid connection with an axial passage in the spindle, the axial passage being connected to a vacuum and/or fluid source, the chuck plate being floatingly and vertically movably located in the housing, a plurality of pressure chambers above the chuck plate, the pressure chambers having lower wall portions which are yieldable and engage the upper side of the chuck plate, pressure manifold means which are connected with a fluid source under pressure and control the pressure in the individual pressure chambers, the lower chamber walls being in frictional engagement with the chuck plate for the transfer of torque from the spindle to the chuck plate, whereby the polishing pressure of the chuck plate essentially is generated by the pressure in the pressure chambers.

2. The chuck means of claim 1, wherein the pressure chambers are concentrically arranged with respect to the axis of the spindle.

3. The chuck means of claim 1, wherein the retaining ring is split and releasably attached to the housing.

4. The chuck means of claim 1, wherein a switching valve for each pressure chamber is provided and located in the housing, the switching valves being connected to a pressure control valve, and the switching valves being connected to an electrical control means through electrical lines in the housing and the spindle, signal transfer means being associated with the spindle or the housing, respectively, to interconnect the electrical control means with the conductors in the spindle.

5. The chuck means of claim 1, wherein a folded diaphragm of flexible material is provided which has upper and lower annular portions which alternate in radial direction, the upper portions being sealingly attached to a plate which is fixed within the housing and the lower portions being defined by annular portions which engage the chuck plate whereby the pressure chambers are formed between the plate and the annular portions.

6. The chuck means of claim 5, wherein the upper portions of the diaphragm are pressed against the plate by means of clamping rings.

7. The chuck means of claim 1, wherein an annular groove is formed at the circumference of the chuck plate, the retaining ring having an annular radially inwardly facing extension which engages the groove in order to limit upward and downward movement of the chuck plate and to guide the chuck plate in vertical direction with respect to the axis of the spindle.

8. The chuck means of claim 1, wherein strain gauges are attached to the upper side of the chuck plate which gauges being connected to an external computer through transfer means associated with the spindle.

9. The chuck means of claim 1, wherein a first part of a releasable fluid coupling is attached to the chuck plate, a second part of the fluid coupling is centrally located in the housing and vertically movable, and the fluid coupling comprising a fluid passage which is connected to the passages in the chuck plate and the passage in the spindle.

10. The chuck means of claim 9, wherein the fluid coupling includes a quick disconnect means.

11. The chuck means of claim 9, wherein the first coupling part has receptacle means connected to the chuck plate, the second coupling part sealingly cooperating with the first coupling part and including a portion extending into the receptacle means, and a quick disconnect screw lock mechanism is provided for the coupling parts.

12. The chuck means of claim 11, wherein the second coupling part has a first vertically movable portion which cooperates with the first coupling part, the first portion being biased towards the chuck plate by a spring, and secured a second portion wherein the first portion is supported for rotational movement and against axial movement, the first portion being supported in the housing such that in a lower position it is secured against rotation and in an upper position is freely rotatable, and a flexible conduit is connected to the second portion which in turn is connected to an axial passage in the spindle.

* * * * *